US010111790B2

(12) United States Patent
Lyon

(10) Patent No.: US 10,111,790 B2
(45) Date of Patent: Oct. 30, 2018

(54) LONG TERM CARE BED

(71) Applicant: Drive Medical Design & Mfg., Port Washington, NY (US)

(72) Inventor: Gregory Lyon, Mamaroneck, NY (US)

(73) Assignee: Medical Depot, Inc., Port Washington, NY (US)

( * ) Notice: Subject to any disclaimer, the term of this patent is extended or adjusted under 35 U.S.C. 154(b) by 333 days.

(21) Appl. No.: 14/739,249

(22) Filed: Jun. 15, 2015

(65) Prior Publication Data

US 2015/0359693 A1 Dec. 17, 2015

Related U.S. Application Data

(60) Provisional application No. 62/011,700, filed on Jun. 13, 2014.

(51) Int. Cl.

| | |
|---|---|
| ***A61G 7/015*** | (2006.01) |
| ***A61G 7/005*** | (2006.01) |
| ***A61G 7/018*** | (2006.01) |
| *A61G 7/012* | (2006.01) |

(52) U.S. Cl.

CPC ..... *A61G 7/015* (2013.01); *A61G 7/005* (2013.01); *A61G 7/018* (2013.01); *A61G 7/012* (2013.01)

(58) Field of Classification Search

CPC ..... A47C 19/045; A61G 1/013; A61G 7/002; A61G 7/005; A61G 7/012; A61G 7/015; A61G 7/018

See application file for complete search history.

(56) References Cited

U.S. PATENT DOCUMENTS

| | | | | |
|---|---|---|---|---|
| 4,104,749 | A | 8/1978 | Grundler | |
| 4,273,306 | A * | 6/1981 | Chang | A47B 9/16 108/145 |
| 4,425,673 | A | 1/1984 | Werner | |
| 4,472,845 | A | 9/1984 | Chivetta et al. | |
| 4,679,261 | A | 7/1987 | Stanley et al. | |
| 4,921,295 | A | 5/1990 | Stollenwerk | |
| 5,105,486 | A | 4/1992 | Peterson | |
| 5,148,562 | A | 9/1992 | Borders et al. | |
| 5,461,740 | A | 10/1995 | Pearson | |
| 5,570,485 | A | 11/1996 | Kurlander et al. | |
| 5,594,961 | A | 1/1997 | Yokoi et al. | |
| 6,209,157 | B1 | 4/2001 | Hensley | |
| 6,357,065 | B1 | 3/2002 | Adams | |

(Continued)

*Primary Examiner* — Nicholas F Polito

(74) *Attorney, Agent, or Firm* — Carter, DeLuca, Farrell & Schmidt, LLP

(57) ABSTRACT

An adjustable bed includes a fixed frame, an articulating frame supported on the fixed frame, first and second leg assemblies, and first and second actuators. The leg assemblies are configured to raise and lower the fixed frame between a lowered position and a raised position. The actuators are disposed and fully maintained within an interior volume of the fixed frame. The first actuator is fixedly secured at a first end to the head end of the fixed frame and operably coupled to the first leg assembly at a second end. The second actuator is fixedly secured at a first end to the foot end of the fixed frame and operably coupled to the second leg assembly at a second end. The first and second actuators are configured to exert a pulling force to raise the fixed frame and to exert a pushing force to lower the fixed frame.

4 Claims, 7 Drawing Sheets

(56) References Cited

U.S. PATENT DOCUMENTS

| | | | |
|---|---|---|---|
| 6,405,393 | B2 | 6/2002 | Megown |
| 6,473,922 | B1 | 11/2002 | Sommerfeld et al. |
| 6,520,460 | B2 | 2/2003 | Hallberg et al. |
| 6,578,216 | B1 | 6/2003 | Aarestad |
| 6,601,251 | B2 | 8/2003 | Paul |
| 6,601,271 | B1 | 8/2003 | Sommerfeld et al. |
| 6,643,873 | B2 | 11/2003 | Heimbrock et al. |
| 6,851,144 | B2 | 2/2005 | Wang |
| 6,868,567 | B2 | 3/2005 | Edgerton |
| 6,880,202 | B2 | 4/2005 | Thompson et al. |
| 6,941,600 | B2 | 9/2005 | Freeborn et al. |
| 7,003,828 | B2 | 2/2006 | Roussy |
| 7,013,510 | B1 | 3/2006 | Johnson |
| 7,055,195 | B2 | 6/2006 | Roussy |
| 7,134,155 | B2 | 11/2006 | Freeborn et al. |
| 7,185,377 | B2 | 3/2007 | Roussy |
| 7,237,289 | B2 | 7/2007 | Loewenthal |
| 7,334,277 | B2 | 2/2008 | Johnson |
| 7,509,697 | B2 | 3/2009 | Dorenbeck |
| 7,596,820 | B2 | 10/2009 | Nielsen et al. |
| 7,631,379 | B2 | 12/2009 | Lindner |
| 7,703,157 | B2 | 4/2010 | Dorenbeck |
| 8,191,940 | B2 | 6/2012 | Bly et al. |
| 2002/0059679 | A1 | 5/2002 | Weismiller et al. |
| 2005/0210588 | A1 | 9/2005 | Loewenthal |
| 2005/0283911 | A1 | 12/2005 | Roussy |
| 2008/0040857 | A1 | 2/2008 | Karmer et al. |
| 2008/0127418 | A1 | 6/2008 | Rawls-Meehan |
| 2008/0127419 | A1 | 6/2008 | Jensen |
| 2008/0208709 | A1 | 8/2008 | Craver |
| 2009/0064414 | A1 | 3/2009 | Andersen et al. |
| 2011/0138536 | A1 | 6/2011 | Wernqvist et al. |
| 2011/0162145 | A1 | 7/2011 | Osborne et al. |

* cited by examiner

LONG TERM CARE BED

CROSS-REFERENCE TO RELATED APPLICATIONS

This application claims the benefit of, and priority to, U.S. Provisional Patent Application No. 62/011,700, filed on Jun. 13, 2014, the entire contents of which are hereby incorporated herein by reference.

BACKGROUND

1. Technical Field

The present disclosure relates to long term care beds, and more particularly, to height-adjustable and articulatable beds and mechanisms for use therewith.

2. Background of Related Art

Adjustable beds are often used in both home care and in more formalized medical settings, e.g., hospital rooms. Adjustable beds generally include a bed frame configured to support a mattress thereon, leg assemblies for supporting the bed frame, and one or more mechanisms for adjusting the height of the bed frame relative to the floor, e.g., to raise/lower the patient and/or for articulating the bed frame, e.g., to position the patient in a lying position, a sitting position, etc.

SUMMARY

In accordance with aspects of the present disclosure, an adjustable bed is provided. The adjustable bed includes a fixed frame, an articulating frame, first and second leg assemblies, and first and second push-pull actuators. The fixed frame includes a head end, a foot end, and first and second spaced-apart sides extending between the head and foot ends so as to define an interior volume of the fixed frame. The articulating frame is supported atop and coupled to the fixed frame. The first and second leg assemblies are configured to support the fixed frame, and raise and lower the fixed frame between a lowered position and a raised position. The first leg assembly is disposed towards the head end of the fixed frame and the second leg assembly is disposed towards the foot end of the fixed frame. Each leg assembly includes a pair of spaced-apart leg members and a pair of spaced-apart leg supports. Each leg member is pivotably and longitudinally slidably coupled to the fixed frame at an upper end thereof. Each leg support is pivotably coupled and longitudinally fixed relative to the fixed frame at first end thereof and pivotably coupled and longitudinally fixed to the corresponding leg member at a second, opposite end thereof. The first and second push-pull actuators are disposed and fully maintained within the interior volume of the fixed frame. The first push-pull actuator is fixedly secured at a first end thereof to the head end of the fixed frame and operably coupled to the upper ends of the leg members of the first leg assembly at a second end of the first push-pull actuator. The second push-pull actuator is fixedly secured at a first end thereof to the foot end of the fixed frame and operably coupled to the upper ends of the leg members of the second leg assembly at a second end of the second push-pull actuator. The first and second push-pull actuators are configured to exert a pulling force on the upper ends of the leg members of the respective first and second leg assemblies to transition the leg assemblies from a lowered position towards a raised position to raise the fixed frame. The first and second push-pull actuators are configured to exert a pushing force on the upper ends of the leg members of the respective first and second leg assemblies to transition the leg assemblies from the raised position towards the lowered position to lower the fixed frame.

In aspects of the present disclosure, the first and second push-pull actuators are independent of one another to permit tilting of the fixed frame between a horizontal orientation, a Trendelenburg orientation, and a reverse-Trendelenburg orientation.

In aspects of the present disclosure, each of the first and second leg assemblies further includes a cross-bar extending between the upper ends of the leg members thereof. In such aspects, the first and second push-pull actuators are engaged with the cross-bars of the respective first and second leg assemblies.

In aspects of the present disclosure, the adjustable bed further includes first and second torque assist mechanisms configured to facilitate the initial raising of the fixed frame from the lowered position towards the raised position.

In aspects of the present disclosure, each of the first and second torque assist mechanisms includes a wedge defining a first cam surface configured to interface with a second cam surface defined on the respective one of the first and second leg assemblies to facilitate the initial raising of the fixed frame from the lowered position towards the raised position.

In aspects of the present disclosure, each of the first and second torque assist mechanisms includes an extension extending from the upper end of the leg member of the respective one of the first and second leg assemblies. In such aspects, the second ends of the first and second actuators are coupled to the extensions of the respective first and second leg assemblies at positions offset from respective positions wherein the respective first and second leg assemblies are pivotably and longitudinally slidably coupled to the fixed frame.

In aspects of the present disclosure, the articulating frame includes a plurality of sections. At least one of the plurality of sections is fixed relative to the fixed frame and at least one other of the plurality of sections is pivotable relative to the fixed frame. More specifically, the articulating frame may include a back section, a hip section, a thigh section, and a foot section. The hip section is fixed relative to the fixed frame, the back section is pivotably coupled to the hip section at a first end of the hip section, the thigh section is pivotably coupled to the hip section at a second, opposite end of the hip section, and the foot section is pivotably coupled to the thigh section.

In aspects of the present disclosure, a first push-pull articulation actuator is disposed and fully maintained within the interior volume of the fixed frame. The first push-pull articulation actuator is fixedly secured at a first end thereof to the head end of the fixed frame and operably coupled to the back section of the articulating frame at a second end of the first push-pull articulation actuator. Additionally or alternatively, a second push-pull articulation actuator may be disposed and fully maintained within the interior volume of the fixed frame, fixedly secured at a first end thereof to the foot end of the fixed frame, and operably coupled to the thigh section of the articulating frame at a second end of the second push-pull articulation actuator.

Another adjustable bed provided in accordance with aspects of the present disclosure includes a fixed frame having a first end and a second end and a central support member extending transversely across the fixed frame, an articulating frame supported atop and coupled to the fixed frame, first and second leg assemblies, and a height adjustment actuation assembly. The leg assemblies are configured to support the fixed frame and raise and lower the fixed frame. The first leg assembly is disposed towards the first end of the fixed frame and the second leg assembly is disposed towards the second end of the fixed frame. Each leg assembly includes a pair of spaced-apart leg members and a cross-bar interconnecting the spaced-apart leg members at upper ends thereof. Each leg member is pivotably and longitudinally slidably coupled to the fixed frame at the upper end thereof. The height adjustment actuation assembly includes a rotatable plate, first and second links, and an actuator. The rotatable plate defines a first end, a second end, and a center portion. The center portion of the rotatable plate is rotatably coupled to the central support member of the fixed frame. The first link is pivotably coupled to the first end of the rotatable plate at a first end of the first link and pivotably coupled to the cross-bar of the first leg assembly at a second end of the first link. The second link is pivotably coupled to the second end of the rotatable plate at a first end of the second link and pivotably coupled to the cross-bar of the second leg assembly at a second end of the second link. The actuator is coupled to the cross-bar of the first leg assembly and configured to urge the cross-bar of the first leg assembly to translate along the fixed frame to raise or lower the first end of the fixed frame. Translation of the cross-bar of the first leg assembly along the fixed frame urges the first link to pivot relative to the fixed frame, the rotatable plate to rotate relative to the fixed frame, and the second link to pivot relative to the fixed frame to translate the cross-bar of the second leg assembly along the fixed frame such that the second end of the fixed frame is raised or lowered in cooperation with the raising or lowering of the first end of the fixed frame.

In aspects of the present disclosure, the actuator is coupled to the cross-bar of the first leg assembly at one end thereof and to the first end of the fixed frame at the other end thereof.

In aspects of the present disclosure, the actuator is coupled to the cross-bar of the first leg assembly at one end thereof and to the cross-bar of the second leg assembly at the other end thereof.

In aspects of the present disclosure, the actuator is configured to exert a pulling force to raise the first and second ends of the fixed frame and to exert a pushing force to lower the first and second ends of the fixed frame.

In aspects of the present disclosure, the articulating frame includes a back section, a hip section, a thigh section, and a foot section. The hip section is fixed relative to the fixed frame, the back section is pivotably coupled to the hip section at a first end of the hip section, the thigh section is pivotably coupled to the hip section at a second, opposite end of the hip section, and the foot section is pivotably coupled to the thigh section.

Another adjustable bed provided in accordance with aspects of the present disclosure includes a fixed frame having a first end and a second end and a central support member extending transversely across the fixed frame, an articulating frame supported atop and coupled to the fixed frame, first and second leg assemblies configured to support the fixed frame, and a height adjustment actuation assembly. The first and second leg assemblies are configured to raise and lower the fixed frame. The first leg assembly is disposed towards the first end of the fixed frame and the second leg assembly is disposed towards the second end of the fixed frame. Each leg assembly includes a pair of spaced-apart leg members and a cross-bar interconnecting the spaced-apart leg members at upper ends thereof. Each leg member is pivotably and longitudinally slidably coupled to the fixed frame at the upper end thereof. The height adjustment actuation assembly includes a pinion rotatably coupled to the central support member of the fixed frame, and first and second rack members operably engaged with the pinion on opposing sides thereof. The first rack member is engaged with the cross-bar of the first leg assembly and the second rack member is engaged with the cross-bar of the second leg assembly such that rotation of the pinion relative to the central support member urges the first rack member in a first direction to raise or lower the first end of the fixed frame and urges the second rack member in a second, opposite direction or raise or lower the second end of the fixed frame in cooperation with the raising or lowering of the first end of the fixed frame.

In aspects of the present disclosure, a drive assembly is mounted underneath the central support member, coupled to the pinion, and configured to drive rotation of the pinion. The drive assembly may include a motor and a worm gear or any other suitable components.

In aspects of the present disclosure, the articulating frame includes a plurality of sections, at least one of which is fixed relative to the fixed frame and at least another of which is pivotable relative to the fixed frame. More specifically, the articulating frame may include a hip section fixed relative to the fixed frame, a back section pivotably coupled to the hip section at a first end of the hip section, a thigh section pivotably coupled to the hip section at a second, opposite end of the hip section, and a foot section pivotably coupled to the thigh section.

To the extent consistent, any of the aspects and features herein may be used in connection with any or all of the other aspects and features detailed herein.

BRIEF DESCRIPTION OF THE DRAWINGS

Various aspects and features of the presently disclosed adjustable bed and mechanisms for use therewith are described with reference to the accompanying drawing figures, wherein like references characters identify similar or identical elements and.

DETAILED DESCRIPTION

Figure 1:
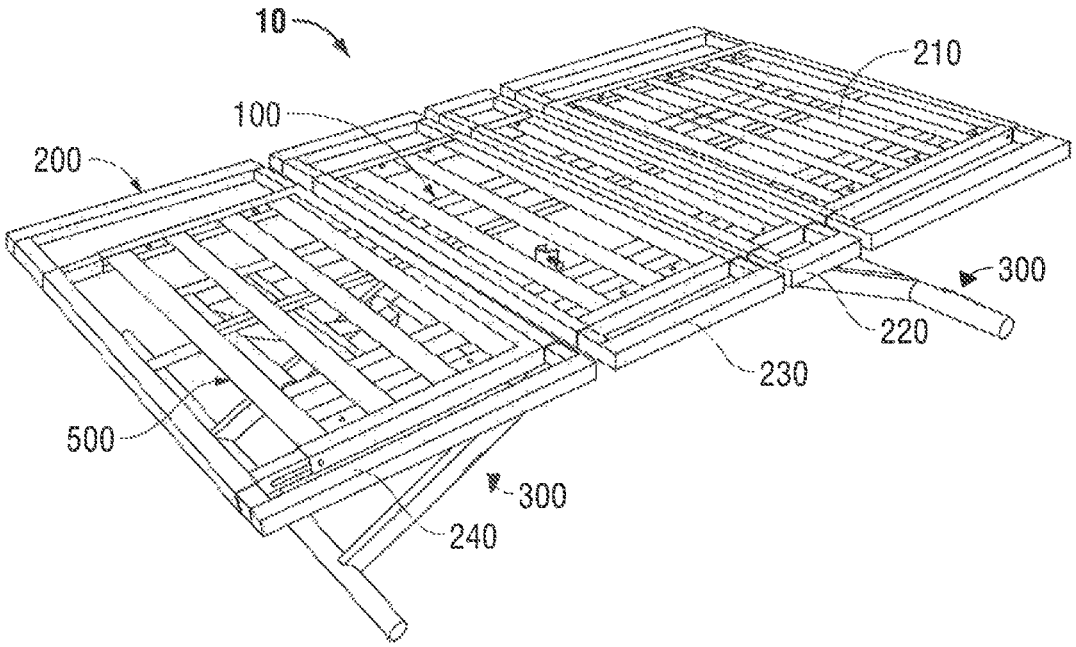
FIG. 1 is a perspective view of an adjustable bed provided in accordance with the present disclosure.
Figure 6:
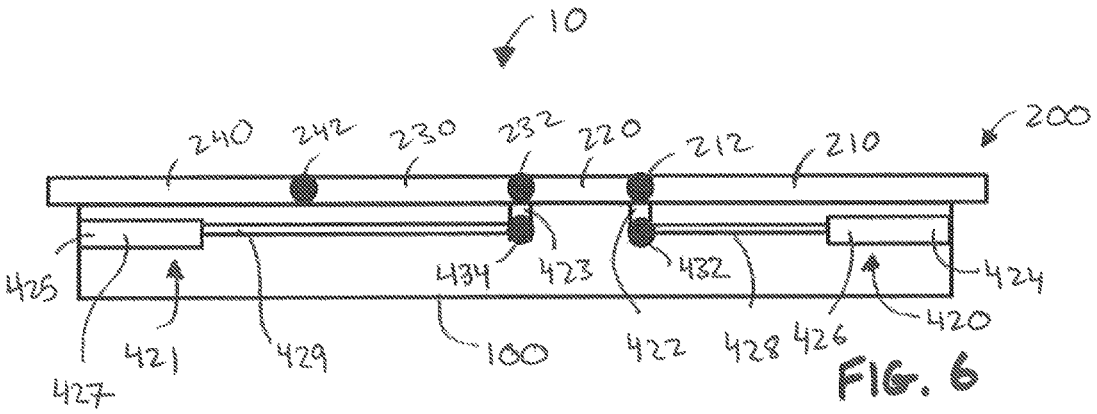
FIG. 6 is a side, cross-sectional view of the adjustable bed of FIG. 1 illustrating the articulating deck sections and actuation assemblies thereof, wherein the adjustable bed is shown in a flat position.
Figure 7:
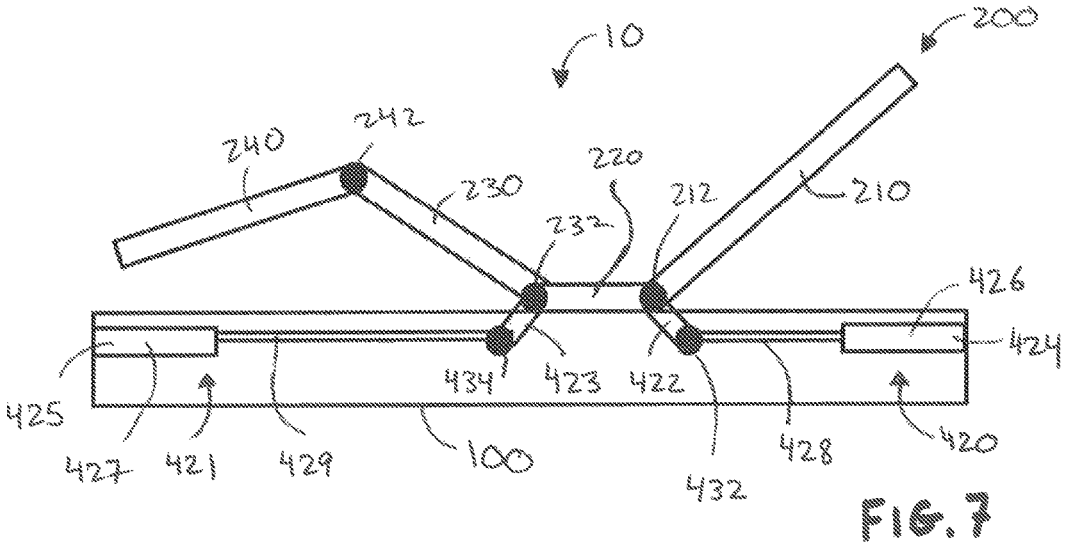
FIG. 7 is a side, cross-sectional view of the adjustable bed of FIG. 1 illustrating the articulating deck sections and actuation assemblies thereof, wherein the adjustable bed is shown in an articulated position.

Turning now to FIG. 1, an adjustable bed provided in accordance with the present disclosure is shown generally identified by reference numeral 10. Bed 10 is particularly suitable for long term care, although bed 10 may also find application in short term care, and/or may be used in both hospital settings as well as in private home care settings. Bed 10 generally includes a fixed frame 100, an articulatable frame 200 articulatably mounted on fixed frame 100, a pair of leg assemblies 300 coupled to fixed frame 100 and extending downwardly therefrom, at least one height adjustment actuation assembly 410 (FIGS. 2-5), and at least one articulation actuation assembly 420, 421 (FIGS. 6 and 7). Bed 10 further includes a slat assembly 500 coupled to articulatable frame 200. Slat assembly 500 is described in detail in U.S. Pat. No. 8,800,080, the entire contents of which are incorporated herein by reference. Bed 10 may additionally include a pair of casters (not shown) coupled to the lower end of each leg assembly 300 on each side thereof to facilitate transport of bed 10.

Fixed frame 100 includes a head end 101*a*, a foot end 101*b*, and defines a generally rectangular-shaped configuration, although other suitable configurations are also contemplated. Fixed frame 100 may further be configured to support head and foot boards (not shown) at the head and foot ends 101*a*, 101*b*, respectively, thereof. As detailed below, leg assemblies 300 are operably coupled to fixed frame 100 to enable height adjustment of bed 10.

Articulatable frame 200 includes a plurality of sections 210, 220, 230, 240 pivotably coupled to one another and/or fixed frame 100 to enable movement at least between a substantially flat or lying position (FIG. 6), a seated position, a legs raised position, and a seated and legs raised position (FIG. 7). More specifically, articulatable frame 200 includes a back section 210, a hip section 220, a thigh section 230, and a lower leg section 240, although greater or fewer than four (4) sections and/or different configurations of sections 210-240 are also contemplated. Hip section 220 is fixedly secured to fixed frame 100. Back section 210 is pivotably coupled to hip section 220 about a first pivot axis 212 and is positioned adjacent to hip section 220 towards head end 101*a* of fixed frame 100. Thigh section 230 is pivotably coupled to hip section 220 about a second pivot axis 232 and is positioned adjacent to hip section 220 towards foot end 101*b* of first frame 100. Foot section 240 is pivotably coupled to thigh section 230 about a third pivot axis 242 towards foot end 101*b* of first frame 100. Foot section 240 is not directly coupled to first frame 100, but, rather, is both pivotable and moveable relative thereto in response to pivoting of thigh section 230. An exemplary articulation mechanism for articulating sections 210, 230, and 240 relative to fixed frame 100 is detailed below with respect to FIGS. 6 and 7.

Referring to FIGS. 2-5, each leg assembly 300 and corresponding height adjustment actuation assembly 410 are substantially similar to one another and, thus, reference below will only be made to one of the leg assemblies 300 and the corresponding height adjustment actuation assembly 410 thereof.

Leg assembly 300 includes a pair of leg members 310, a pair of leg supports 320, a cross-bar 330, and a base-bar 340. Leg members 310 are spaced-apart and disposed on either side of fixed frame 100. Each leg member 310 defines an upper end 312 that is slidably and rotatably coupled to fixed frame 100 via a roller 314 received within a track 316 defined within fixed frame 100. Cross-bar 330 is engaged with and extends between upper ends 312 of leg members 310. Base-bar 340 is engaged with and extends between lower ends 318 of leg members 310. Each leg support 320 is pivotably coupled to a corresponding leg member 310 via a pivot pin 322 at a lower end 324 and pivotably coupled to fixed frame via a pivot pin 326 at an upper end 328 thereof.

Height adjustment actuation assembly 410 is configured to transition leg assembly 300 between a lowered position and a raised position. Height adjustment actuation assembly 410 is fully disposed within the interior dimensions of fixed frame 100 and is maintained therein regardless of the position of leg assembly 300. Such a configuration establishes a low-profile and eliminates entrapment points due to offset positioning of the height adjustment actuation assembly relative to the fixed frame. Height adjustment actuation assembly 410 includes a push-pull actuator 412 having an actuator base 414 and an actuator arm 416 telescopically extendable/retractable relative to actuator base 414. Actuator base 414 is fixedly engaged with and extends inwardly from an end of fixed frame 100. The free end of actuator arm 416 is engaged with cross-bar 330 of leg assembly 300. As such, extension and retraction of actuator arm 416 relative to actuator base 414 pushes cross-bar 330 away from actuator 412 and pulls cross-bar 330 towards actuator 412, respectively. Movement of cross-bar 330, in turn, translates upper ends 312 of leg members 310 along fixed frame 100, guided via the engagement of rollers 314 within tracks 316. As an alternative to providing cross-bar 330 and coupling actuator arm 416 thereto, height adjustment actuation assembly 410 may extend adjacent a side of fixed frame 100 such that actuator arm 416 couples directly to the upper end 312 of the corresponding leg member 310. Regardless of the configuration, the operation of height adjustment actuation assembly 410 is similar as detailed below.

Figure 2:
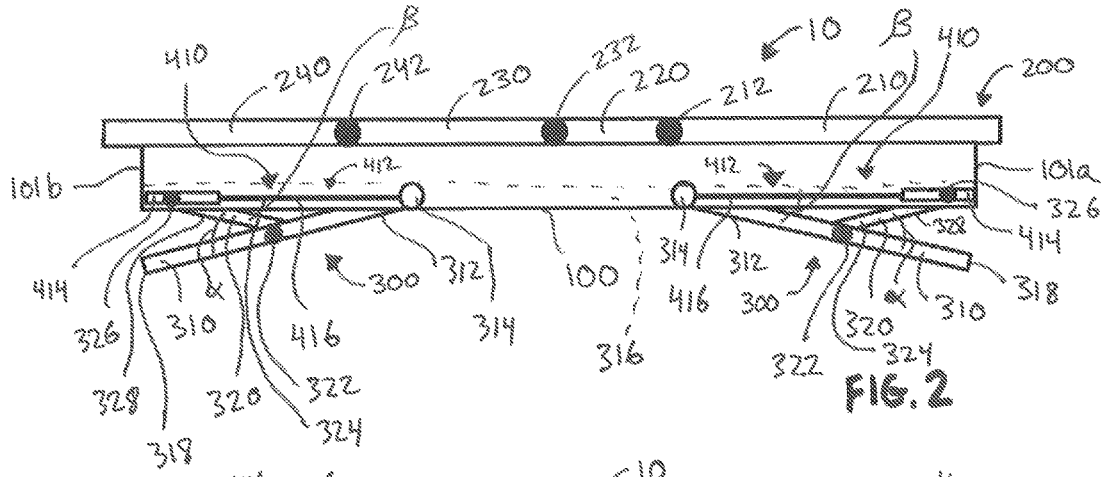
FIG. 2 is a side, cross-sectional view of the adjustable bed of FIG. 1 illustrating the leg and actuation assemblies thereof, wherein the adjustable bed is shown in a lowered position.
Figure 4:
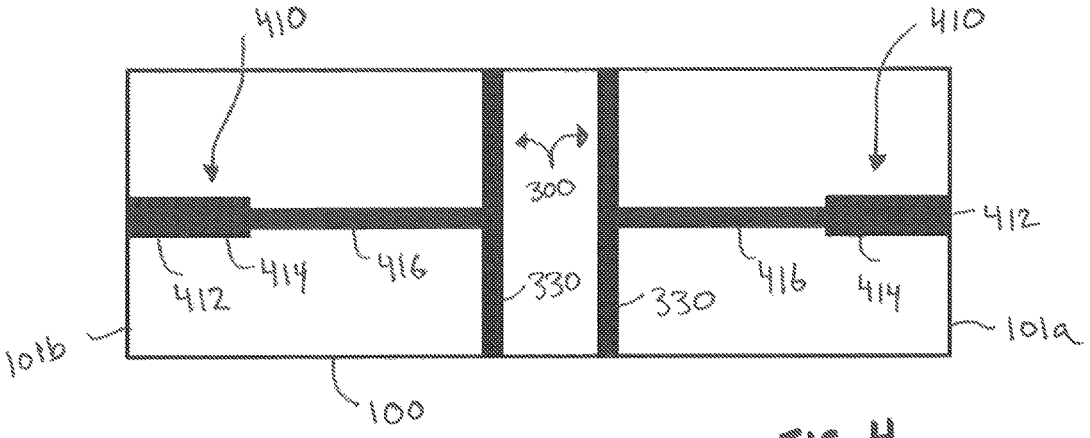
FIG. 4 is a top view of the fixed frame and actuation assemblies of the adjustable bed of FIG. 1, wherein the adjustable bed is shown in the lowered position.

As shown in FIGS. 2 and 4, leg assembly 300 and height adjustment actuation assembly 410 are shown in the lowered position of bed 10. In this lowered position, actuator 412 is disposed in extended positions, rollers 314 are disposed towards the longitudinal middle of fixed frame 100, angle $\alpha$ defined between leg supports 320 and leg members 310 is at a maximum, and angle $\beta$ defined between leg supports 320 and fixed frame 100 is at a minimum.

Figure 3:
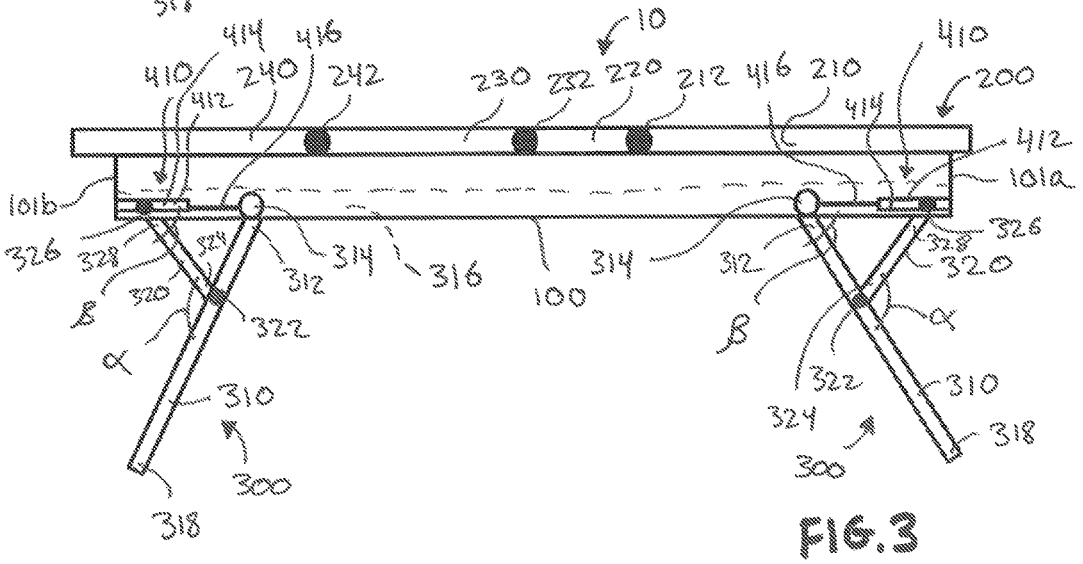
FIG. 3 is a side, cross-sectional view of the adjustable bed of FIG. 1 illustrating the leg and actuation assemblies thereof, wherein the adjustable bed is shown in a raised position.
Figure 5:
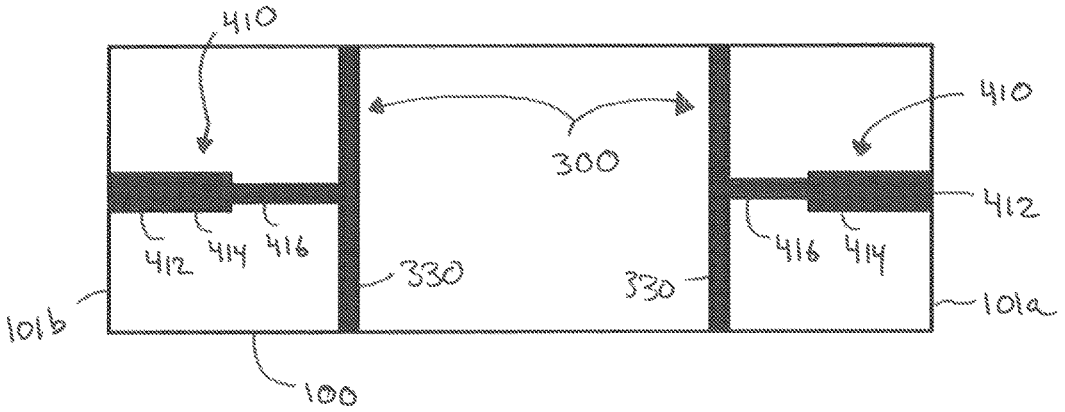
FIG. 5 is a top view of the fixed frame and actuation assemblies of the adjustable bed of FIG. 1, wherein the adjustable bed is shown in the raised position.

With additional reference to FIGS. 3 and 5, in order to transition bed 10 to the raised position, actuator 412 is activated in a pulling mode to retract actuator arm 416 into actuator base 414. As a result of the retraction or pulling of actuator 412, rollers 314 are moved towards the respective ends of fixed frame 100 to thereby pull cross-bar 330 towards actuator 412. During such movement, angles $\alpha$ and β are increased. Upon reaching the raised position, rollers 314 are disposed towards the longitudinal end of fixed frame 100 and angles α and β are at a maximum.

In order to return bed 10 to the lowered position, actuator 412 is activated in a pushing or extension mode to thereby return rollers 314 towards the longitudinal middle of fixed frame 100, push cross-bar 330 towards the longitudinal middle of fixed frame 100, and decrease angles α and β. In some embodiments, although their operation is similar, actuators 412 may be independent of one another, thus permitting raising and lowering of leg assemblies 300 to different heights, e.g., to achieve the Trendelenburg and reverse-Trendelenburg positions.

Turning now to FIGS. 6 and 7, with respect to articulation of articulatable frame 200 relative to fixed frame 100, first and second articulation actuation assemblies 420, 421, respectively, are operably coupled between fixed frame 100 and back section 210, and between fixed frame 100 and thigh section 230, respectively. First articulation actuation assembly 420 includes an extension 422 that extends perpendicularly relative to back section 210 and may be engaged therewith or monolithically formed with back section 210. Extension 422 may be disposed on one side of back section 210 or may extend transversely across back section 210 from one side to the other. First articulation actuation assembly 420 further includes a push-pull actuator 424 having an actuator base 426 and an actuator arm 428 telescopically extendable/retractable relative to actuator base 426. Actuator base 426 is fixedly engaged with and extends inwardly from an end of fixed frame 100. The free end of actuator arm 428 is pivotably engaged with extension 422 (at an end of back section 210 or an intermediate position therebetween) about a fourth pivot axis 432 that is offset relative to first pivot axis 212, about which back section 210 is pivotable relative to hip section 220. As a result of this offset positioning, actuation of actuator 424 in a pulling mode pulls extension 422 towards actuator 424, thereby urging back section 210 to rotate about first pivot axis 212 from a substantially flat position (FIG. 6) to an articulated position (FIG. 7).

Second articulation actuation assembly 421 includes an extension 423 that extends perpendicularly relative to thigh section 230 and may be engaged therewith or monolithically formed with thigh section 230. Second articulation actuation assembly 421 further includes a push-pull actuator 425 having an actuator base 427 and an actuator arm 429 telescopically extendable/retractable relative to actuator base 427. Actuator base 427 is fixedly engaged with and extends inwardly from an end of fixed frame 100. The free end of actuator arm 429 is pivotably engaged with extension 423 about a fifth pivot axis 434 that is offset relative to second pivot axis 232, about which thigh section 230 is pivotable relative to hip section 220. As a result of this offset positioning, actuation of actuator 425 in a pulling mode pulls extension 423 towards actuator 425, thereby urging thigh section 230 to rotate about second pivot axis 232 from a substantially flat position (FIG. 6) to an articulated position (FIG. 7). As noted above, pivoting of thigh section 230 effects lifting of foot section 240 relative to fixed frame 100 and pivoting of foot section 240 relative to thigh section 230 about third pivot axis 242.

In order to return back section 210 and/or thigh section 230 to their respective flat positions, actuators 424, 425 are actuated in a push mode to thereby urge extensions 422, 423 in the opposite direction from that detailed above. Further, first and second articulation actuation assemblies 420, 421, respectively, may be actuated in conjunction with one another or independently of one another to achieve each of a substantially flat or lying position (FIG. 6), a seated position, a legs raised position, and a seated and legs raised position (FIG. 7).

Figure 8:
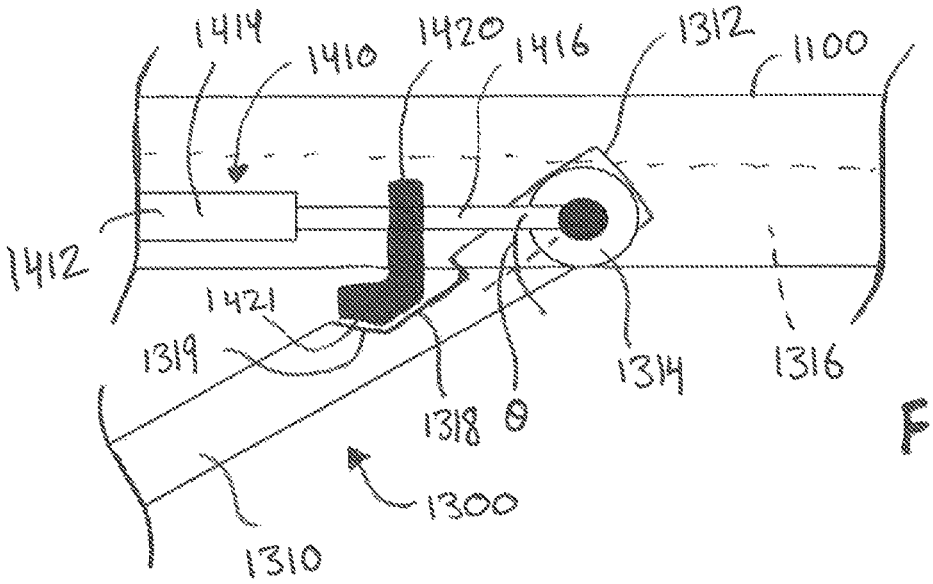
FIG. 8 is a side, cross-sectional view of a torque-assist feature configured for use with the adjustable bed of FIG. 1.
Figure 9:
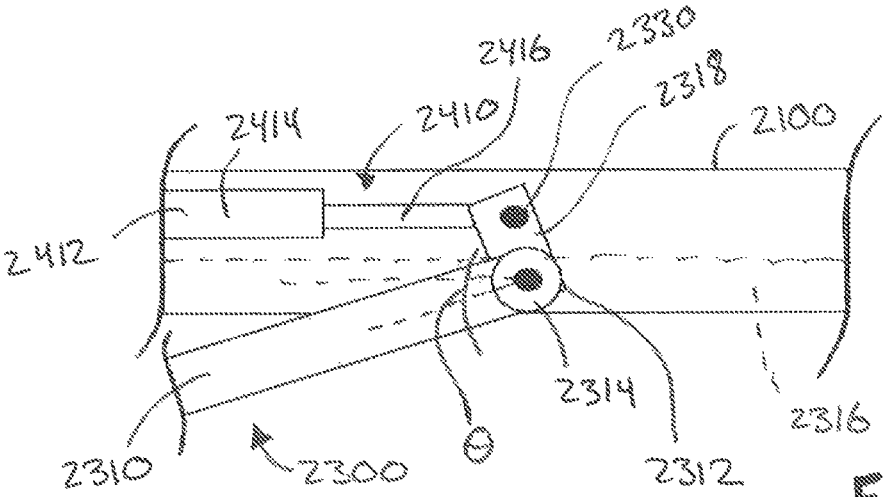
FIG. 9 is a side, cross-sectional view of another torque-assist feature configured for use with the adjustable bed of FIG. 1.

Turning now to FIGS. 8 and 9, when an adjustable bed is disposed in the lowered position, angle θ defined between the leg member and the actuator arm is at a minimum. The angle θ is the angle about which a lifting torque is developed to raise the adjustable bed and, thus, when this angle is at a minimum, a significant mechanical disadvantage is introduced. Detailed below with reference to FIGS. 8 and 9 are embodiments of torque-assist features provided in accordance with the present disclosure and configured to compensate for the mechanical disadvantage of angle θ being at a minimum, thereby facilitating the initial raising of the adjustable bed from the lowered position.

Referring to FIG. 8, a portion of a fixed frame 1100 of an adjustable bed is shown including a height adjustment actuation assembly 1410 and a leg assembly 1300 operably coupled thereto for raising and lowering the adjustable bed. The adjustable bed further includes another leg assembly and corresponding height adjustment actuation assembly that are identical in configuration to height adjustment actuation assembly 1410 and leg assembly 1300 and, thus, are not shown and described herein for purposes of brevity. Further, unless specifically contradicted below, fixed frame 1100, height adjustment actuation assembly 1410, and leg assembly 1300 may be similar to and/or include any of the features of fixed frame 100 (FIG. 1), height adjustment actuation assembly 410 (FIGS. 2 and 3), and leg assembly 300 (FIGS. 2 and 3) of adjustable bed 10 (FIG. 1), as detailed above.

Leg assembly 1300 includes a pair of leg members 1310 (only one of which is shown), a pair of leg supports (not shown), a cross-bar (not shown), and a base-bar (not shown). Leg members 1310 are spaced-apart and disposed on either side of fixed frame 1100. Each leg member 1310 defines an upper end 1312 that is slidably and rotatably coupled to fixed frame 1100 via a roller 1314 received within a track 1316 defined within fixed frame 1100. At least one of the leg members 1310 defines a cut-out 1318 towards upper end 1312 thereof. Cut-out 1318 includes a first cam surface 1319, the importance of which is detailed below.

Height adjustment actuation assembly 1410 is disposed towards one side of fixed frame 1100, e.g., adjacent one of the leg assemblies 1300. Height adjustment actuation assembly 1410 includes a push-pull actuator 1412 having an actuator base 1414 and an actuator arm 1416 telescopically extendable/retractable relative to actuator base 1414. Actuator base 1414 is fixedly engaged with and extends inwardly from an end of fixed frame 1100. The free end of actuator arm 1416 is pivotably engaged with upper end 1312 of leg member 1310 such that extension and retraction of actuator arm 1416 relative to actuator base 1414 translates upper end 1312 of leg member 1310 along fixed frame 1100. Height adjustment actuation assembly 1410 further includes a wedge 1420 engaged about actuator arm 1416 and depending downwardly therefrom. Wedge 1420 defines a second cam surface 1421.

Continuing with reference to FIG. 8, in the lowered position of leg assembly 1300, wherein angle θ is at a minimum, wedge 1420 is at least partially disposed within cut-out 1318 of leg member 1310 such that first and second cam surfaces 1319, 1421, respectively, abut one another. As a result of this configuration, upon the initial retraction of actuator arm 1416 to initiate raising of the adjustable bed, wedge 1420 is translated along fixed frame 1100 and relative to leg member 1310 such that first and second cam surfaces 1319, 1421, respectively, cam along one another, thereby urging leg member 1310 downwardly and facilitating the initial raising of leg assembly 1300. This interaction between first and second cam surfaces 1319, 1421 assists in the initial raising of leg assembly 1310 so as to compensate for the mechanical disadvantage of angle θ being at a minimum. Cut-out 1318 and wedge 1420 are configured such that, once leg assembly 1310 is raised to achieve a sufficiently large angle θ, first and second cam surfaces 1319, 1421, respectively, slide past one another and wedge 1420 is withdrawn from cut-out 1318. Thus, once a sufficiently large angle θ is achieved, the assistance of the camming action of wedge 1420 within cut-out 1318 is removed and further raising of leg assembly 1310 is achieved solely via actuator arm 1416 pulling upper end 1312 of leg member 1310 towards actuator 1412.

With reference to FIG. 9, a portion of a fixed frame 2100 of an adjustable bed is shown including a height adjustment actuation assembly 2410 and a leg assembly 2300 operably coupled thereto for raising and lowering the adjustable bed. The adjustable bed further includes another leg assembly and corresponding height adjustment actuation assembly that are identical in configuration to height adjustment actuation assembly 2410 and leg assembly 2300 and, thus, are not shown and described herein for purposes of brevity. Further, unless specifically contradicted below, fixed frame 2100, height adjustment actuation assembly 2410, and leg assembly 2300 may be similar to and/or include any of the features of fixed frame 100 (FIG. 1), height adjustment actuation assembly 410 (FIGS. 2 and 3), and leg assembly 300 (FIGS. 2 and 3) of adjustable bed 10 (FIG. 1), as detailed above.

Leg assembly 2300 includes a pair of leg members 2310 (only one of which is shown), a pair of leg supports (not shown), a cross-bar 2330, and a base-bar (not shown). Leg members 2310 are spaced-apart and disposed on either side of fixed frame 2100. Each leg member 2310 defines an upper end 2312 that is slidably and rotatably coupled to fixed frame 2100 via a roller 2314 received within a track 2316 defined within fixed frame 2100. Each leg member 2310 further includes an extension 2318 extending from upper end 2312 thereof in generally perpendicular orientation relative to the corresponding leg member 2310. Extensions 2318 may be monolithically formed with leg members 2310 or may be engaged thereto in any suitable fashion. Cross-bar 2330 is pivotably coupled to and extends between extensions 2318 of leg members 2310. Cross-bar 2330 defines a pivot axis that is offset above the pivot axes of rollers 2314, about which leg members 2310 pivot relative to fixed frame 2110.

Height adjustment actuation assembly 2410 includes a push-pull actuator 2412 having an actuator base 2414 and an actuator arm 2416 telescopically extendable/retractable relative to actuator base 2414. Actuator base 2414 is fixedly engaged with and extends inwardly from an end of fixed frame 2100. The free end of actuator arm 2416 is engaged with cross-bar 2330 at a position offset above the pivot axes of roller 2314. Extension and retraction of actuator arm 2416 relative to actuator base 2414 pulls cross-bar 2330 towards actuator 2410, thereby pulling extensions 2318 towards actuator 2410. Pulling extensions 2318 towards actuator 2410 likewise translates rollers 2314 along fixed frame 2100 towards actuator 2410 and effects pivoting of leg members 1310 about rollers 2314 to raise leg assembly 1300.

The positioning of the pivot axis of cross-bar 2330 offset above the pivot axes of rollers 2314 allows extensions 2318 to serve as a lever arm to facilitate development of a starting torque, thereby compensating for the mechanical disadvantage of angle θ being at a minimum when the adjustable bed is in the lowered position.

Figure 10A:
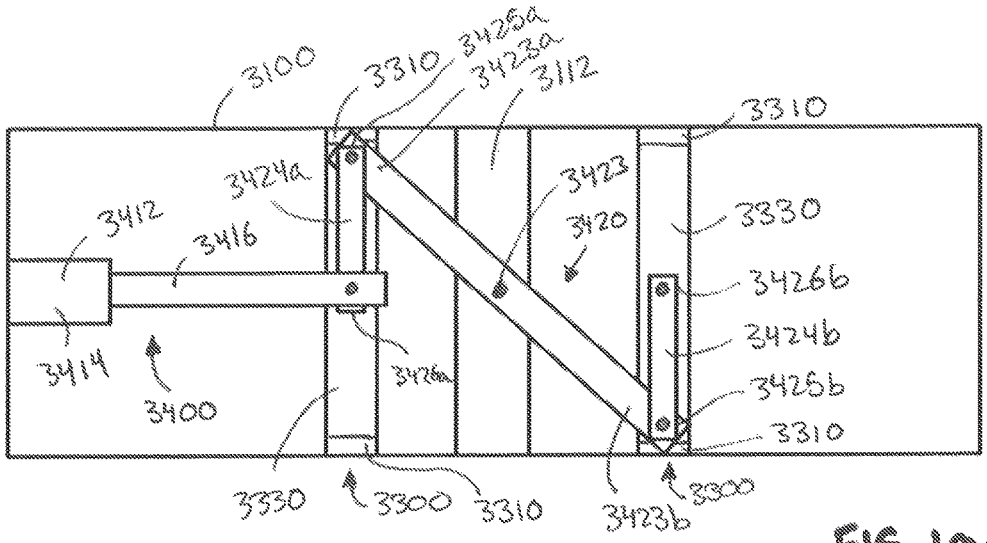
FIG. 10A is a top view of a frame and height adjustment mechanism provided in accordance with the present disclosure and configured for use with an adjustable bed, wherein the height adjustment mechanism is disposed in a first position corresponding to the lowered position of the adjustable bed.
Figure 10B:
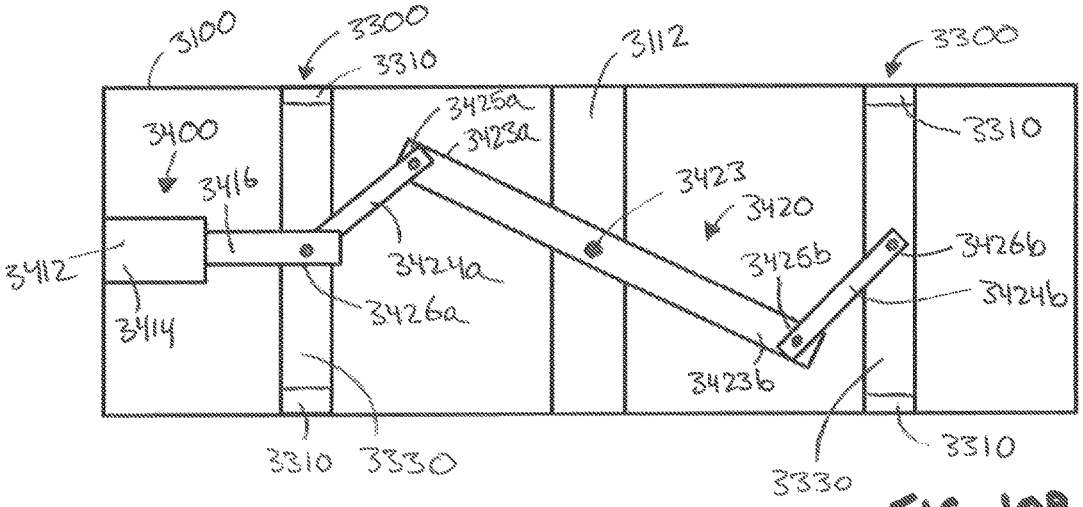
FIG. 10B is a top view of the frame and height adjustment mechanism of FIG. 10A, wherein the height adjustment mechanism is disposed in a second position corresponding to the raised position of the adjustable bed.

Turning to FIGS. 10A and 10B, another height adjustment actuation assembly 3400 provided in accordance with the present disclosure and configured for use with an adjustable bed, e.g., adjustable bed 10 (FIG. 1), is shown operably coupled to a fixed frame 3100, and first and second cross-bars 3330 of respective leg assemblies 3300 for enabling raising and lowering of leg assemblies 3300. Unless specifically contradicted below, fixed frame 3100 and leg assemblies 3300 may be similar to and/or include any of the features of fixed frame 100 (FIG. 1) and leg assemblies 300 (FIGS. 2 and 3) of adjustable bed 10 (FIG. 1), as detailed above.

Fixed frame 3100 defines a generally rectangular-shaped configuration and includes a head end 3101*a* and a foot end 3101*b*. A central support member 3112 is fixedly engaged with and extends transversely across fixed frame 3100.

Each leg assembly 3300 includes a pair of leg members 3310, a pair of leg supports (not shown), a cross-bar 3330, and a base-bar (not shown). Each leg member 3310 defines an upper end that is slidably and rotatably coupled to fixed frame 3100, e.g., via a roller (not shown) received within a track (not shown) defined within fixed frame 3100, similarly as detailed above. Cross-bars 3330 are engaged with and extend between the upper ends of the leg members 3310 of each leg assembly 3300.

Height adjustment actuation assembly 3400 is configured to transition leg assemblies 3300 between a lowered position and a raised position, using a single actuator. Height adjustment actuation assembly 3400 is fully disposed within the interior dimensions of fixed frame 3100 and is maintained therein regardless of the position of leg assemblies 3300. Such a configuration establishes a low-profile and eliminates entrapment points due to offset positioning of the height adjustment actuation assembly relative to the fixed frame. Height adjustment actuation assembly 3400 includes a single push-pull actuator 3412 having an actuator base 3414 and an actuator arm 3416 telescopically extendable/retractable relative to actuator base 3414. Actuator base 3414 is fixedly engaged with and extends inwardly from an end of fixed frame 3100. The free end of actuator arm 3416 is engaged with the cross-bar 3330 of one of the leg assemblies 3300, e.g., the leg assembly 3300 closest to actuator 3412.

Height adjustment actuation assembly 3400 further includes a linkage mechanism 3420 configured to enable cooperative raising and lowering of leg assemblies 3300 using a single actuator 3412. Linkage mechanism 3420 includes a rotatable plate 3422 pivotably coupled to central support member 3112 of fixed frame 3100 via a pivot pin 3423 extending through a center of rotatable plate 3422. Linkage mechanism 3420 further includes a pair of links 3424*a*, 3424*b* each including a first end 3425*a*, 3425*b* and a second end 3426*a*, 3426*b*, respectively. First end 3425*a* of link 3424*a* is pivotably coupled to a first end 3423*a* of rotatable plate 3422, while first end 3425*a* of link 3424*b* is pivotable coupled to the second, opposite end 3423*b* of rotatable plate 3422. Second end 3426*a* of link 3424*a* is pivotably coupled to both the free end of actuator arm 3416 and the cross-bar 3330 of the leg assembly 3300 adjacent thereto, although it is also contemplated that second end 3426*a* of link 3424*a* be pivotably coupled to only one of the free end of actuator arm 3416 and the cross-bar 3330 of the leg assembly 3300 adjacent thereto. Second end 3426*b* of link 3424*b* is pivotably coupled to the cross-bar 3330 of the other leg assembly 3300.

As a result of the above-detailed configuration, retraction or pulling of actuator arm 3416 of actuator 3412 pulls cross-bar 3330 towards actuator 3412, thereby moving the leg assembly 3300 adjacent thereto towards the raised position, similarly as detailed above. This pulling of cross-bar 3330 towards actuator 3412 likewise pulls link 3424*a* towards actuator 3412 while also allowing rotation of link 3424*a* relative to cross-bar 3300 and rotatable plate 3422. The proximal movement and rotation of link 3424*a* urges first end 3423*a* of rotatable plate 3422 towards the longitudinal center of fixed frame 3100, thereby urging rotatable plate 3422 to rotate about pivot pin 3423 in a counter-clockwise direction from the orientation illustrated in FIGS. 10A and 10B. Rotation of rotatable plate 3422 in this manner effects rotation of second end 3423*b* of rotatable plate 3422 towards the longitudinal center of fixed frame 3100, thereby urging link 3424*b* to extend away from central support member 3112 of fixed frame 3100. As link 3424*b* is extended away from central support member 3112 of fixed frame 3100, cross-bar 3330 is likewise urged away from central support member 3112 thereby moving the leg assembly 3300 associated with that cross-bar 3330 towards the raised position in conjunction with the raising of the other leg assembly 3330.

Lowering of leg assemblies 3300 is effected in the opposite manner as detailed above. That is, in order to lower leg assemblies 3300, actuator arm 3416 of actuator 3412 is extended or pushed to thereby push the adjacent cross-bar 3330 away from actuator 3412 to move that leg assembly 3300 towards the lowered position. At the same time, the movement of that cross-bar 3330 towards actuator 3412 pushes link 3424*a* towards central support member 3112 and urges link 3424*a* to rotate, thereby urging rotatable plate 3422 to rotate in a clockwise direction from the orientation illustrated in FIGS. 10A and 10B. Rotation of rotatable plate 3422 in this manner effects rotation of second end 3423*b* of rotatable plate 3422 towards the side of fixed frame 3100, thereby pulling link 3424*b* towards central support member 3112 of fixed frame 3100 and, accordingly, pulling the cross-bar 3330 of the attached leg assembly 330 towards central support member 3112 to move that leg assembly 3300 towards the lowered position.

With respect to the above-detailed configuration in FIGS. 10A and 10B, as an alternative to fixedly engaging actuator base 3414 with an end of fixed frame 3100 and having the free end of actuator arm 3416 engaged with the cross-bar 3330 of one of the leg assemblies 3300, actuator base 3414 may be fixedly mounted on the cross-bar 3330 (on an underside thereof) of one of the leg assemblies 3300, and the free end of actuator arm 3416 may fixedly mounted on the cross-bar 3330 (on an underside thereof) of the other leg assembly 3300. In such a configuration, linkage mechanism 3420 would operate as detailed above to ensure cooperative movement of leg assemblies 3300 during extension and retraction of actuator 3412. Extension of actuator 3412 would urge cross-bars 3330 towards each other to lower leg assemblies 3330, while retraction of actuator 341 would urge cross-bars 3330 apart from each other to raise leg assemblies 3330. In this configuration, by providing a "floating" actuator, the effective load can be halved, thus reducing the size of the actuator required.

Figure 11:
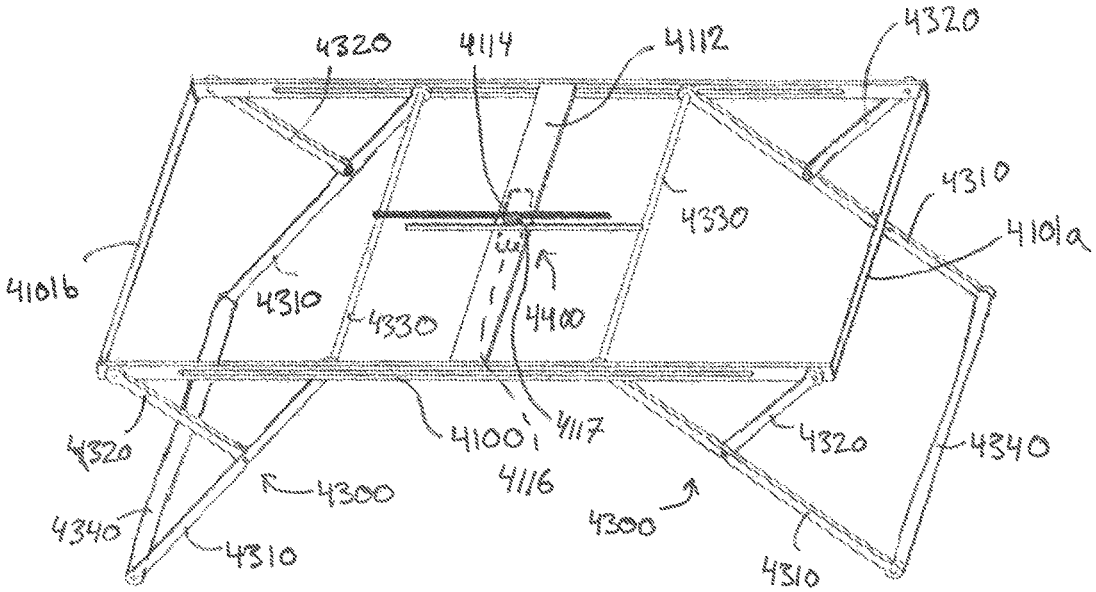
FIG. 11 is a perspective view of a frame, height adjustment mechanism, and leg assemblies provided in accordance with the present disclosure and configured for use with an adjustable bed.

Turning now to FIG. 11, another embodiment of a height adjustment actuation assembly 4400 provided in accordance with the present disclosure and configured for use with an adjustable bed is shown operably coupled to a fixed frame 4100 and first and second leg assemblies 4300 for enabling raising and lowering of leg assemblies 4300. Unless specifically contradicted below, fixed frame 4100 and leg assemblies 4300 may be similar to and/or include any of the features of fixed frame 100 (FIG. 1) and leg assemblies 300 (FIGS. 2 and 3) of adjustable bed 10 (FIG. 1), as detailed above.

Fixed frame 4100 defines a generally rectangular-shaped configuration and includes a head end 4101*a* and a foot end 4101*b*. A central support member 4112 is fixedly engaged with and extends transversely across fixed frame 4100. A vertical pin 4114 of height adjustment actuation assembly 4400 extends through central support member 4112. A drive assembly 4116, e.g., a motor operably coupled to a worm gear, an actuator, or other suitable drive mechanism, of height adjustment actuation assembly 4400 is mounted underneath central support member 4112 and is operably engaged with vertical pin 4114 such that rotation of drive assembly 4116 effects corresponding rotation of vertical pin 4114 relative to central support member 4112 to raise and lower leg assemblies 4300, as described in greater detail below.

Each leg assembly 4300, similarly as detailed above with respect to leg assemblies 300 (FIGS. 2 and 3) includes a pair of leg members 4310 pivotable and slidably coupled to fixed frame 4100, a pair of leg supports 4320 each pivotably coupled to fixed frame 4100 and one of leg members 4310, a pair of cross-bars 4330 extending between the upper ends of respective leg members 4310, and a pair of base-bars 4340 extend between the lower ends of respective leg members 4310.

Height adjustment actuation assembly 4400 is configured to transition leg assemblies 4300 between a lowered position and a raised position, using a single actuator, e.g., drive assembly 4116, is fully disposed within the interior dimensions of fixed frame 4100, and is maintained therein regardless of the position of leg assemblies 4300. As noted above, height adjustment actuation assembly 4400 includes a vertical pin 4114 that extends through central support member 4112 and a drive assembly 4116 operably engaged with vertical pin 4114 such that rotation of drive assembly 4116 effects corresponding rotation of vertical pin 4114 relative to central support member 4112. Height adjustment actuation assembly 4400 further includes a pinion 4117 mounted about vertical pin 4114 on an upper side of central support member 4112, and a pair of racks 4119 operably engaged with pinion 4117 on opposing sides thereof. One of the racks 4119 extends to and is engaged with the cross-bar 4330 of one of the leg assemblies 4300 and the other rack 4119 extends in the opposite direction to engage the cross-bar 4330 of the other leg assembly 4300.

As a result of the above-detailed configuration, upon driving drive assembly 4116 to rotate vertical pin 4114 and, thus, pinion 4117 in a first direction, racks 4119 are translated in relative to fixed frame 4100 to urge cross-bars 4330 apart from one another, thereby raising leg assemblies 4300. On other hand, upon driving drive assembly 4116 to rotate vertical pin 4114 and, thus, pinion 4117 in a second, opposite direction, racks 4119 are translated relative to fixed frame 4100 to urge cross-bars 4330 towards one another, thereby lowering leg assemblies 4300.

The above description, disclosure, and figures should not be construed as limiting, but merely as exemplary of particular embodiments. It is to be understood, therefore, that the disclosure is not limited to the precise embodiments described, and that various other changes and modifications may be effected by one skilled in the art without departing from the scope or spirit of the present disclosure. Additionally, persons skilled in the art will appreciate that the features illustrated or described in connection with one embodiment may be combined with those of another, and that such modifications and variations are also intended to be included within the scope of the present disclosure. Therefore, the above description should not be construed as limiting, but merely as exemplifications of particular embodiments.

What is claimed is:

1. An adjustable bed, comprising:

a fixed frame having a first end, a second end, a first side, and a second side cooperating to define an interior volume of the fixed frame, the fixed frame further including a central support member extending transversely across the fixed frame between the first and second sides thereof;

an articulating frame supported atop and coupled to the fixed frame;

first and second leg assemblies configured to support the fixed frame, the first and second leg assemblies configured to raise and lower the fixed frame, the first leg assembly disposed towards the first end of the fixed frame and the second leg assembly disposed towards the second end of the fixed frame, each leg assembly including a pair of spaced-apart leg members and a cross-bar interconnecting the spaced-apart leg members at upper ends thereof, each leg member pivotably and longitudinally slidably coupled to the fixed frame at the upper end thereof; and a height adjustment actuation assembly fully disposed within the interior volume of the fixed frame, the height adjustment actuation assembly including:

a rotatable plate defining a first end, a second end, and a center portion, the center portion of the rotatable plate rotatably coupled to the central support member of the fixed frame;

a first link pivotably coupled to the first end of the rotatable plate at a first end of the first link and pivotably coupled to the cross-bar of the first leg assembly at a second end of the first link;

a second link pivotably coupled to the second end of the rotatable plate at a first end of the second link and pivotably coupled to the cross-bar of the second leg assembly at a second end of the second link; and an actuator coupled to the cross-bar of the first leg assembly, the actuator configured to urge the cross-bar of the first leg assembly to translate along the fixed frame to raise or lower the first end of the fixed frame, wherein translation of the cross-bar of the first leg assembly along the fixed frame urges the first link to pivot relative to the fixed frame, the rotatable plate to rotate relative to the fixed frame, and the second link to pivot relative to the fixed frame to translate the cross-bar of the second leg assembly along the fixed frame such that the second end of the fixed frame is raised or lowered in cooperation with the raising or lowering of the first end of the fixed frame.

2. The adjustable bed according to claim 1, wherein the actuator is coupled to the cross-bar of the first leg assembly at one end thereof and to the first end of the fixed frame at the other end thereof.

3. The adjustable bed according to claim 1, wherein the actuator is configured to exert a pulling force to raise the first and second ends of the fixed frame and to exert a pushing force to lower the first and second ends of the fixed frame.

4. The adjustable bed according to claim 1, wherein the articulating frame includes a back section, a hip section, a thigh section, and a foot section, the hip section fixed relative to the fixed frame, the back section pivotably coupled to the hip section at a first end of the hip section, the thigh section pivotably coupled to the hip section at a second, opposite end of the hip section, and the foot section pivotably coupled to the thigh section.

* * * * *